US006499856B2

(12) United States Patent
Lee

(10) Patent No.: US 6,499,856 B2
(45) Date of Patent: Dec. 31, 2002

(54) BEACH UMBRELLA WITH LAMPS

(76) Inventor: Chorng-Cheng Lee, No. 272, Lane 365, Wu Feng South Road, Chia Yi (TW)

( * ) Notice: Subject to any disclaimer, the term of this patent is extended or adjusted under 35 U.S.C. 154(b) by 0 days.

(21) Appl. No.: 09/861,607

(22) Filed: May 22, 2001

(65) Prior Publication Data

US 2002/0176247 A1 Nov. 28, 2002

(51) Int. Cl.[7] ..... A45B 3/02

(52) U.S. Cl. ..... 362/102; 362/234; 362/249; 135/910

(58) Field of Search ..... 362/102, 184, 362/249, 234; 135/16, 910

(56) References Cited

U.S. PATENT DOCUMENTS 6,089,727 A * 7/2000 Wu ..... 362/102
6,302,560 B1 * 10/2001 Lai ..... 362/249

* cited by examiner

*Primary Examiner*—Sandra O'Shea
*Assistant Examiner*—John Anthony Ward
(74) *Attorney, Agent, or Firm*—Rosenberg, Klein & Lee

(57) ABSTRACT

A beach umbrella with lamps includes mainly a plurality of spreaders and ribs respectively having a C-shaped insert groove opening downward, and a plurality of small lamps fitted in each C-shaped groove as if hidden in the spreaders and the ribs, and a switch fixed on a lower portion of the shank to turn on and off the small lamps so as to facilitate assembly and use of the beach umbrella with lamps. Then the lamps may be lit on and off to shine in the umbrella during nighttime to set forth gracious atmosphere.

2 Claims, 5 Drawing Sheets

BEACH UMBRELLA WITH LAMPS

BACKGROUND OF THE INVENTION

This invention relates to a beach umbrella with lamps, particularly standing on the ground and useable at night for lighting to set forth gracious atmosphere as well.

Conventional beach umbrellas are widely used not only at beaches but outdoor leisure coffee or refreshment stands for shading people from hot sunshine during the daytime so as to permit them rest comfortably.

Conventional beach umbrellas generally have a shank, a plurality of spreaders fitted on the shank and spread outward radially, and a plurality of ribs combined with the spreaders for supporting a canopy sewn on the ribs. Then conventional beach umbrellas are spread for hiding people sitting under the umbrella from hot sunlight during daytime, but always collapsed during the night lest they should hide lamplight or place temporarily lamps in the umbrellas to supply proper illumination.

But conventional beach umbrellas have to be lighted with extra lamps during the night, not convenient to use, as they have to be collapsed by manual work and cannot be taken away as they are mostly fixed on the ground. Besides, should there be any dirt on the umbrellas, the dirt may fall down on the ground to litter an outdoor resting area in case of the umbrella collapsed. So some businessmen hang small lamps on the spreaders of a conventional beach umbrella for lighting, but it is not so suitable to decorate an outdoor resting area for taking refreshments or coffee.

SUMMARY OF THE INVENTION

The objective of the invention is to offer a beach umbrella with lamps fixed under a lower side of each spreader and each rib, which have respectively a C-shaped insert groove for lamps to fit therein. Then the lamps are simple to combine with the spreaders and the ribs of a beach umbrella, not spoil the whole beautifulness of the beach umbrella, but producing gracious atmosphere during night in an outdoor resting area.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
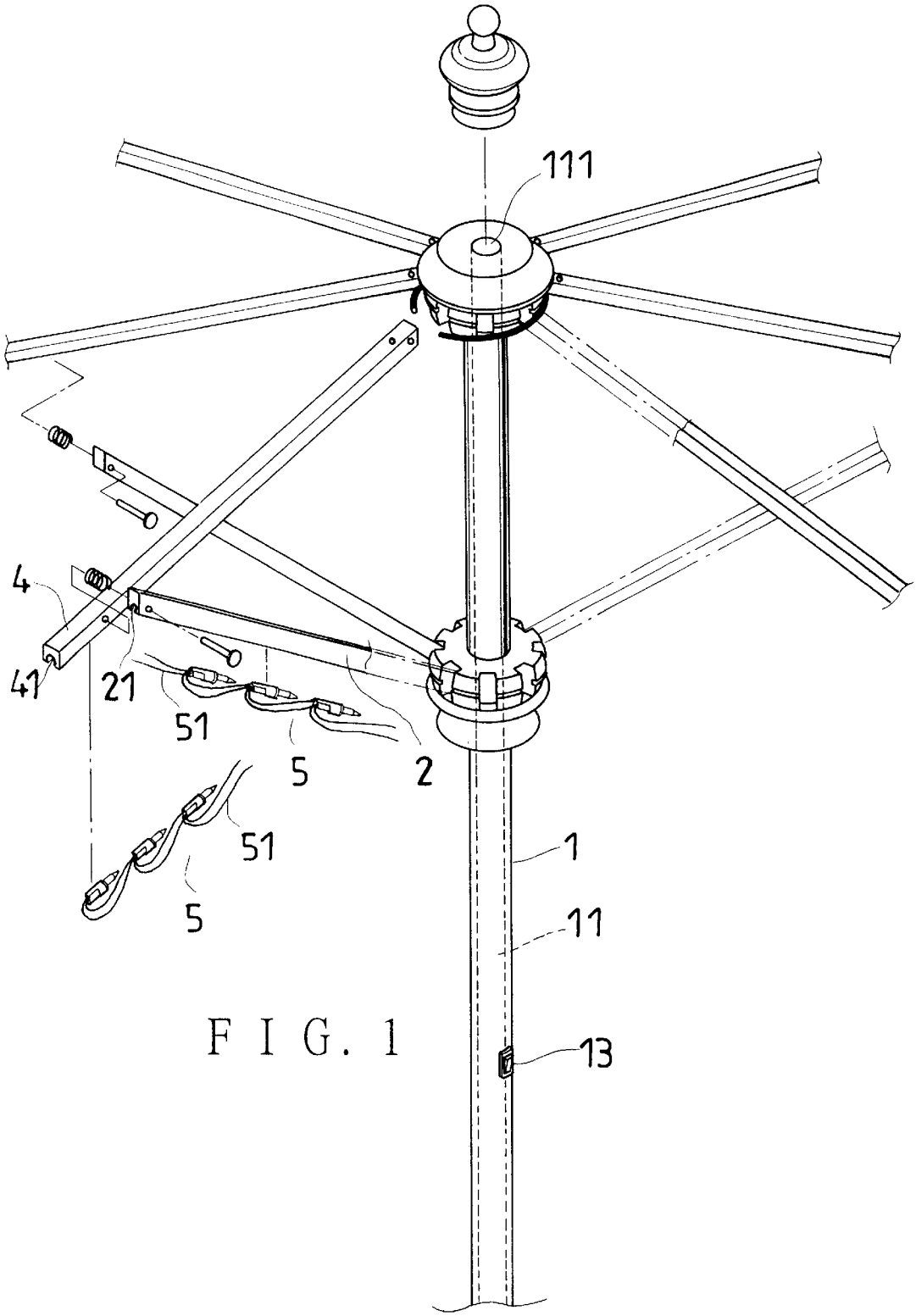
FIG. 1 is an exploded perspective view of a first embodiment of a beach umbrella with lamps of the present invention.
Figure 4:
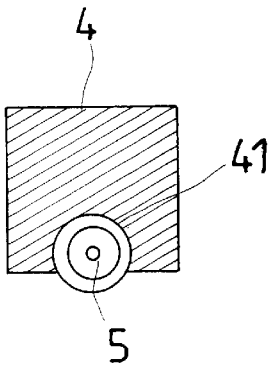
FIG. 4 is a front cross-sectional view of the rib combined with lamps of the present invention.
Figure 3:
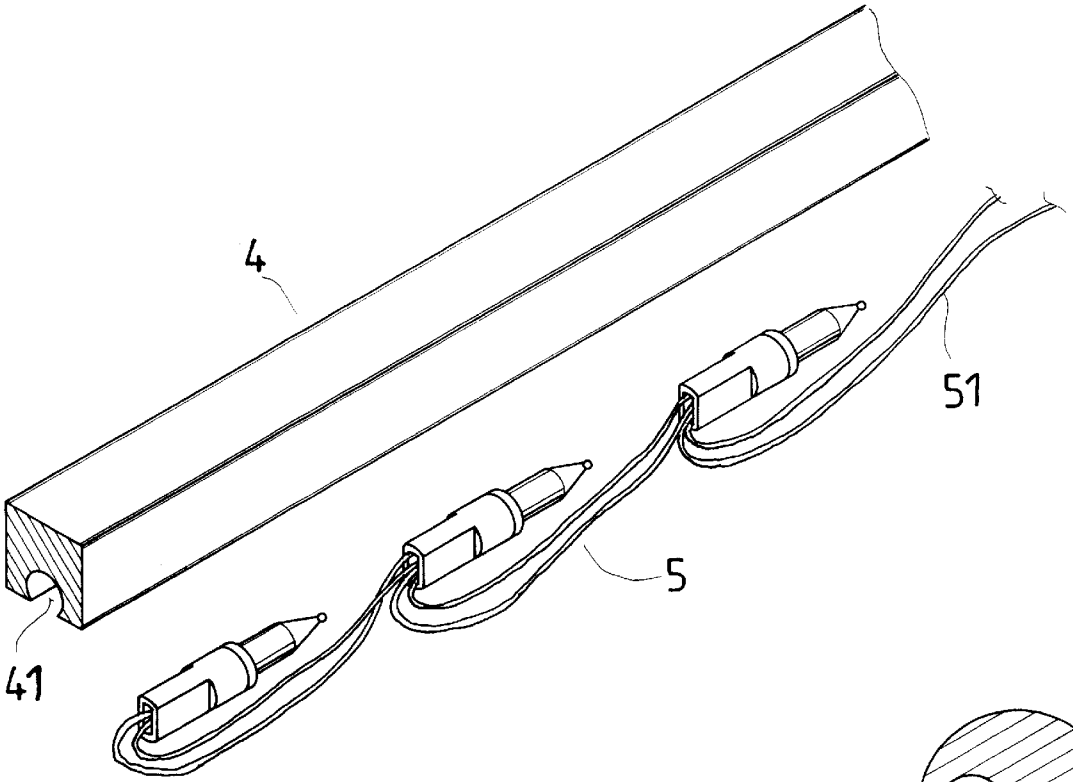
FIG. 3 is a magnified perspective view of a rib and lamps with lead wires of the present invention.
Figure 5:
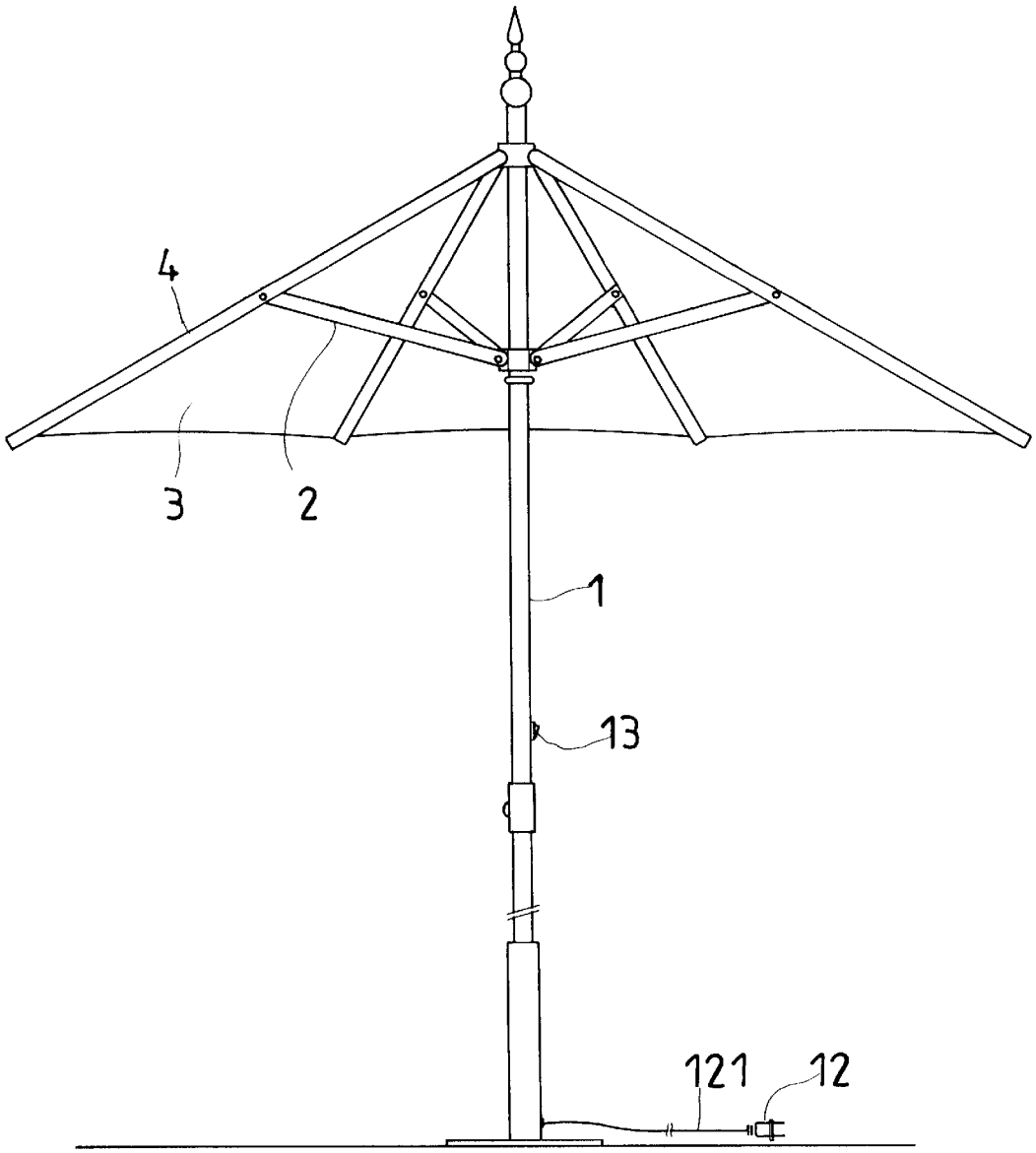
FIG. 5 is a view of the beach umbrella in spread using condition of the present invention.

A first embodiment of a beach umbrella with lamps in the present invention, as shown in FIG. 1, includes a shank 1, a plurality of spreaders 2 fitted on the shank 1 by means of a ring, a plurality of ribs 4 having respectively an intermediate portion pivotally connected with a related one of the spreaders 2, and a canopy 3 covering on the ribs 4 as shown in FIG. 5, having the same structure as a conventional beach umbrellas. The main improvement in the invention is all the spreaders 2 and all the ribs 4 respectively provided with a lengthwise C-shaped insert groove 21 and 41 formed in a lower portion and opening downward, as shown in FIG. 3. Then a plurality of small lamps 5 are fitted in the insert groove 21 or 41 of each spreader 2 or each rib 4. The front end of each small lamp 5 faces to the shank 1 so as not to let the lamps interfere with the shank 1, as shown in FIG. 4.

Figure 2:
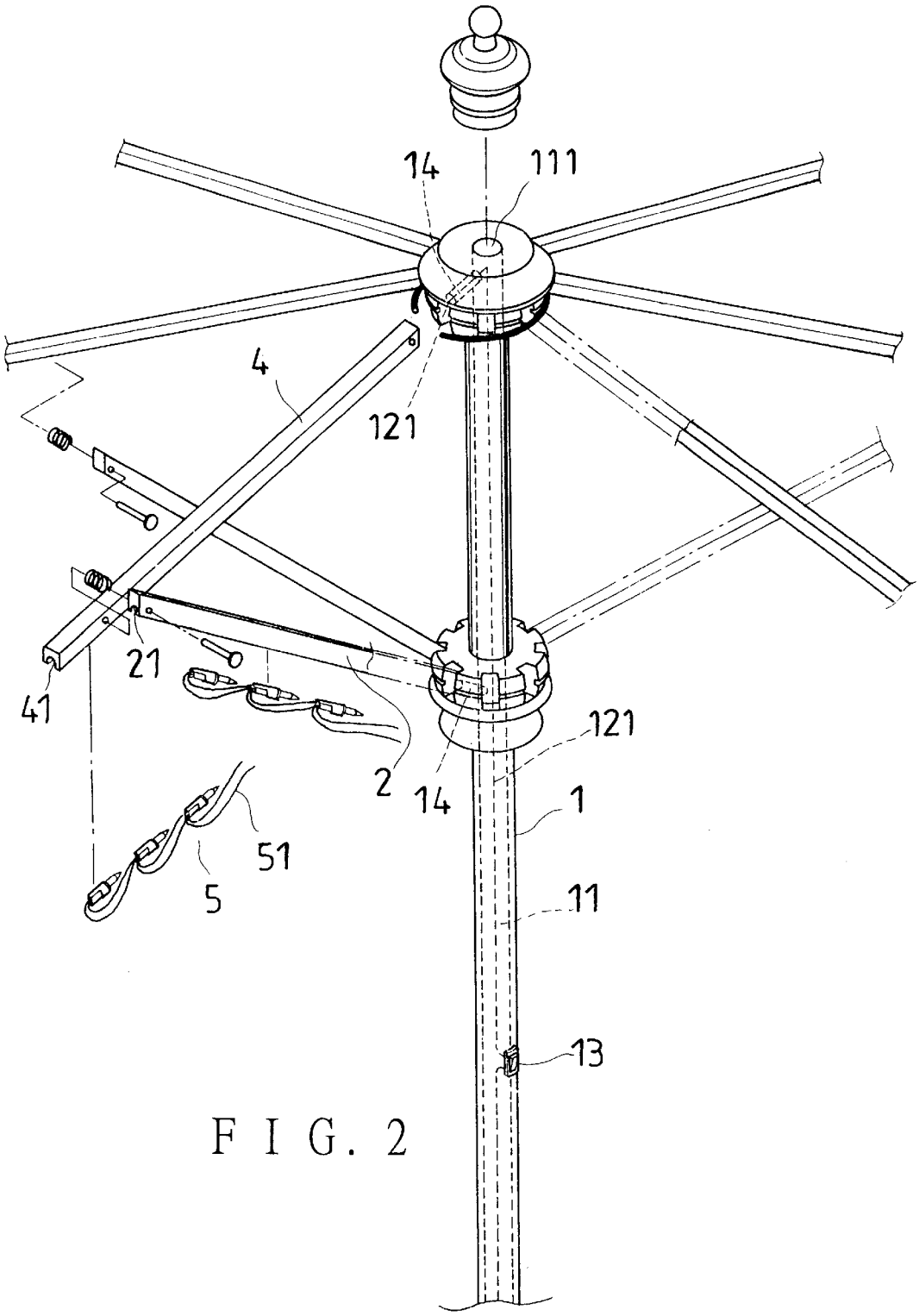
FIG. 2 is an exploded perspective view of a second embodiment of a beach umbrella with lamps of the present invention.
Figure 7:
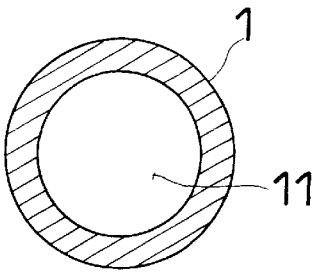
FIG. 7 is an upper cross-sectional view of a solid shank of the present invention.
Figure 6:
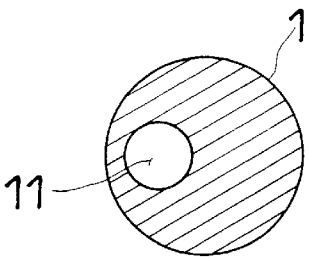
FIG. 6 is an upper cross-sectional view of a hollow shank of the present invention.
Figure 8:
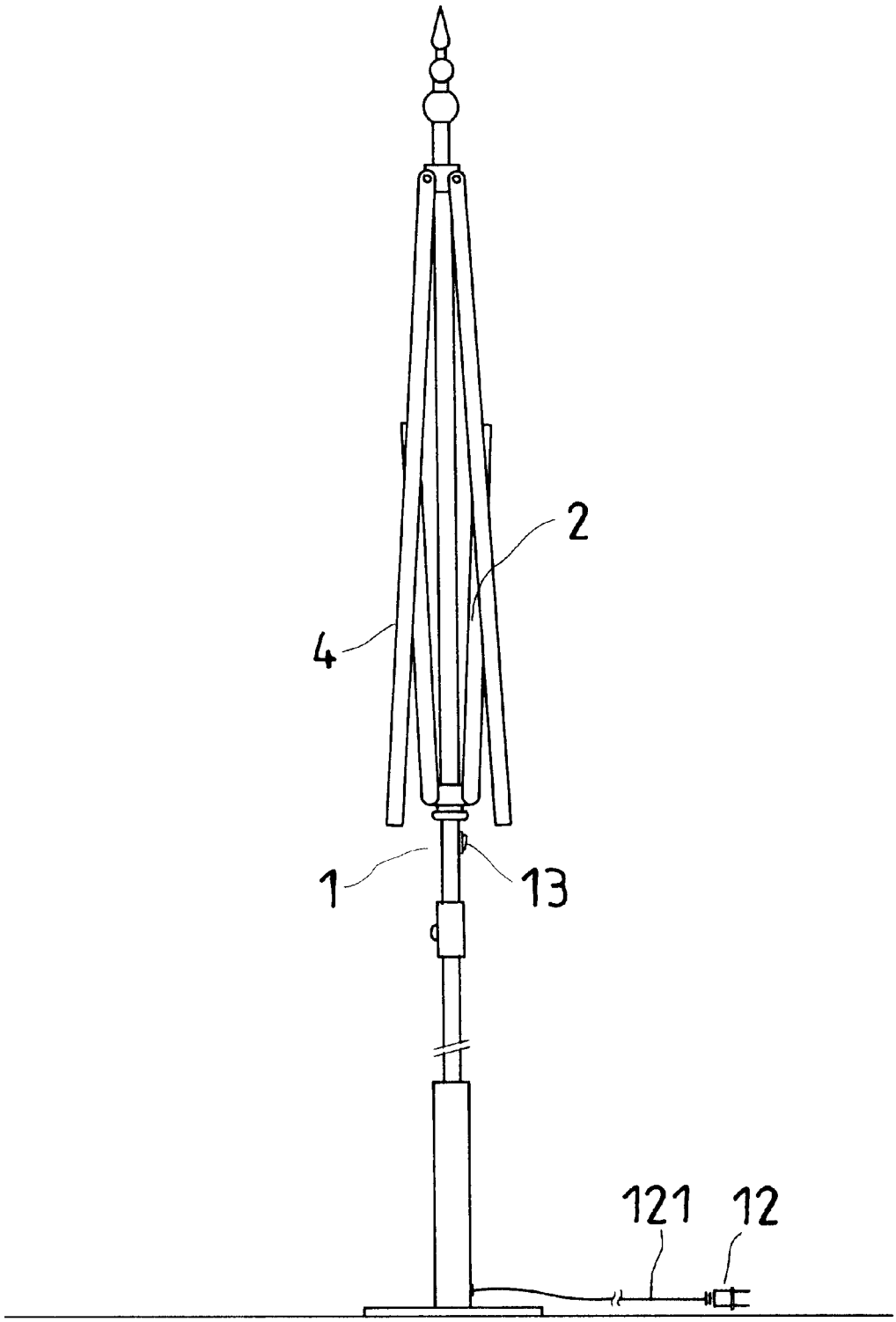
FIG. 8 is a view of the beach umbrella with lamps of the collapsed condition of the present invention.

Next, referring to FIG. 2, the shank 1 has an inner tube 11 in the whole length for receiving lead wires 121 therein, and a plug 12 connected to the lead wires 121, shown in FIG. 5, having their one ends connected to a power switch 13 fixed on an outer surface at a proper location of the shank 1, and the other ends connected to power wires 51 of the small lamps 5 so as to light up the lamps 5. The lead wires 121 pass through the inner tube 11 upward to extend into an opening 111 in an upper end of the shank 1 and pass through a plurality of holes 14 bored in the shank 1 and then connected to the power wires of the small lamps 5. The location of the power switch 13 should be below the ring connected with inner ends of all the spreaders in the collapsed condition, as shown in FIG. 8. The inner tube 11 may not be necessary, if a hollow shank 1 is used as shown in FIG. 6, utilizing the center hollow functioning as an inner tube 11. If the shank 1 is a solid rod, an eccentric hollow may be bored to function as an inner tube 11 as shown in FIG. 7.

As understood from the above description, the small lamps 5 are fitted in the insert grooves of all the spreaders and all the ribs, not protruding out of them, convenient to use and assemble, not affecting the wholeness of the beach umbrella to light up during night to set forth gracious atmosphere.

What is claimed is:

1. A beach umbrella with lamps, comprising:

a conventional beach umbrella including a longitudinally extended shank having a bore extending longitudinally therethrough, a ring fitted movably around said shank, a plurality of spreaders pivotally connected to said ring and adapted to spread out radially, a plurality of ribs each having an intermediate portion pivotally connected to an outer end of a corresponding one of said spreaders and an upper end of each of said ribs being pivotally connected to an upper ring fixed on an upper end of said shank, and a canopy covered on said plurality ribs;

each said spreader having a C-shaped lengthwise groove formed in a lower portion thereof and opening downwardly, each said rib having a C-shaped lengthwise groove formed in a lower portion thereof and opening downwardly, a plurality of small lamps fitted in each said C-shaped groove of each of said plurality of spreaders and each of said plurality of ribs, each of said small lamps having power wires extending from a rear end thereof, said shank having lead wires passing through said bore for coupling to a power source on one end of said lead wires and to said power wires of said plurality small lamps on an opposing end of said lead wires.

2. The beach umbrella with lamps as claimed in claim 1, wherein each of said plurality of small lamps inserted in said C-shaped groove of each of said spreaders and each of said ribs have a front end facing said shank for avoiding interference between said small lamps and said shank.

* * * * *